US006921254B2

(12) United States Patent
Wu

(10) Patent No.: US 6,921,254 B2
(45) Date of Patent: Jul. 26, 2005

(54) PUMP

(76) Inventor: Scott Wu, No. 6, Lane 176, Wu Fu Road, Wu Feng Hsiang, Taichung Hsien (TW)

( * ) Notice: Subject to any disclaimer, the term of this patent is extended or adjusted under 35 U.S.C. 154(b) by 170 days.

(21) Appl. No.: 10/385,949

(22) Filed: Mar. 10, 2003

(65) Prior Publication Data

US 2003/0194336 A1 Oct. 16, 2003

(30) Foreign Application Priority Data

Apr. 13, 2002 (TW) ..... 91205256 U

(51) Int. Cl.[7] ..... F04B 39/10; F01B 11/02; F25G 3/00

(52) U.S. Cl. ..... 417/569; 92/164; 92/171.1; 403/375

(58) Field of Search ..... 417/548, 569, 417/454, 571; 92/164, 171.1; 403/375, 332

(56) References Cited

U.S. PATENT DOCUMENTS 1,612,853 A * 1/1927 Broderick ..... 92/164
2,469,328 A * 5/1949 Cox ..... 96/118
2,518,787 A * 8/1950 Huhtala ..... 92/164
5,806,406 A * 9/1998 Pettersson ..... 92/164
6,017,201 A * 1/2000 Yang ..... 417/454
6,464,477 B1 * 10/2002 Wu ..... 417/569
6,592,287 B1 * 7/2003 Hagle et al. ..... 403/277
6,739,842 B2 * 5/2004 Wu ..... 417/63

* cited by examiner

*Primary Examiner*—Charles G. Freay
(74) *Attorney, Agent, or Firm*—Alan D. Kamrath; Nikolai & Mersereau, P.A.

(57) ABSTRACT

A pump includes a cylinder, a piston, a connecting rod, a plug, a nozzle and a fastener. The cylinder includes a first open end and a second open end. The piston is movable in the cylinder. The connecting rod includes a first end connected with the piston in the cylinder and a second end located outside the cylinder. The plug is fit in the first open end of the cylinder. The nozzle is mounted on the first open end of the cylinder. The fastener is used to fasten the nozzle and the plug to the cylinder.

11 Claims, 3 Drawing Sheets

PUMP

BACKGROUND OF INVENTION

1. Field of Invention

The present invention relates to a pump.

2. Related Prior Art

Taiwanese Patent Publication No. 228258 discloses a pump including a cylinder 10 and a nozzle 40 connected with the cylinder 10 by threading. That is, a thread 11 must be formed on an internal side of the cylinder 10, and a thread 41 must be formed on an external side of the nozzle 40. It is time-consuming to form the threads 11 and 41. The cylinder 10 is made of light but weak aluminum. The thread 11 is formed via tapering. Therefore, the cylinder 10 must be adequately thick in order to exhibit a sufficient strength after the tapering. The thicker the cylinder 10 is, the more aluminum is required to make the cylinder 10. This entails a high cost in manufacturing the cylinder 10. In addition, air tends to leak between the threads 11 and 41.

The present invention is therefore intended to obviate or at least alleviate the problems encountered in the prior art.

SUMMARY OF INVENTION

It is an objective of the present invention to provide a pump that can be manufactured in a time-economic manner.

It is another objective of the present invention to provide a pump that can be manufactured at a low cost.

It is still another objective of the present invention to provide a pump that can avoid leakage of air.

According to the present invention, a pump includes a cylinder, a piston, a connecting rod, a plug, a nozzle and a fastener. The cylinder includes a first open end and a second open end. The piston is movable in the cylinder. The connecting rod includes a first end connected with the piston in the cylinder and a second end located outside the cylinder. The plug is fit in the first open end of the cylinder. The nozzle is mounted on the first open end of the cylinder. The fastener is used to fasten the nozzle and the plug to the cylinder.

Other objectives, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings wherein.

DETAILED DESCRIPTION OF PREFERRED EMBODIMENT

Figure 1:
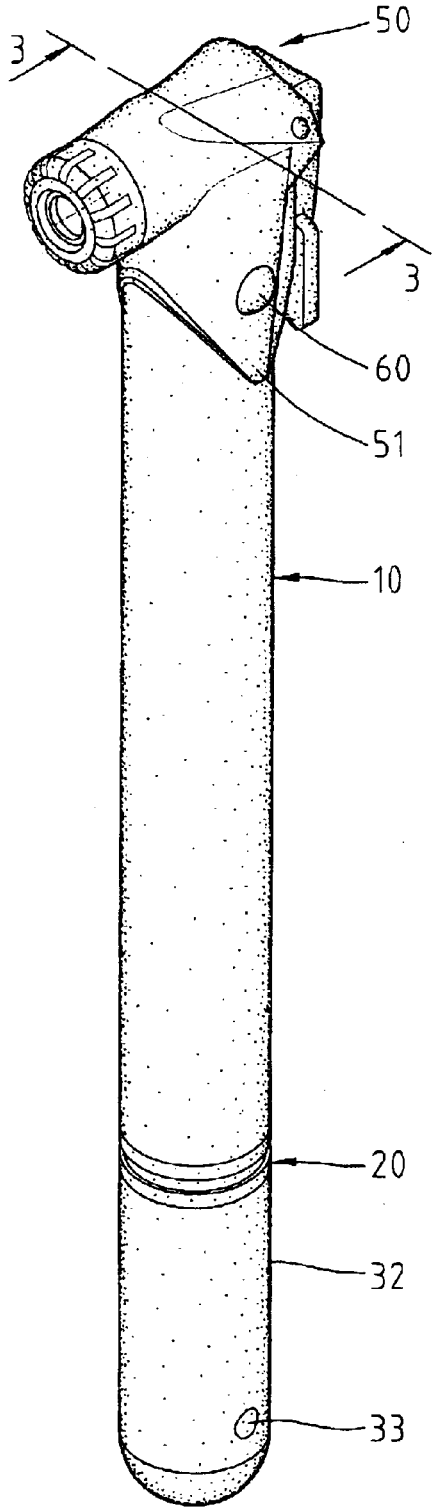
FIG. 1 is a perspective view of a pump according to a first embodiment of the present invention.
Figure 2:
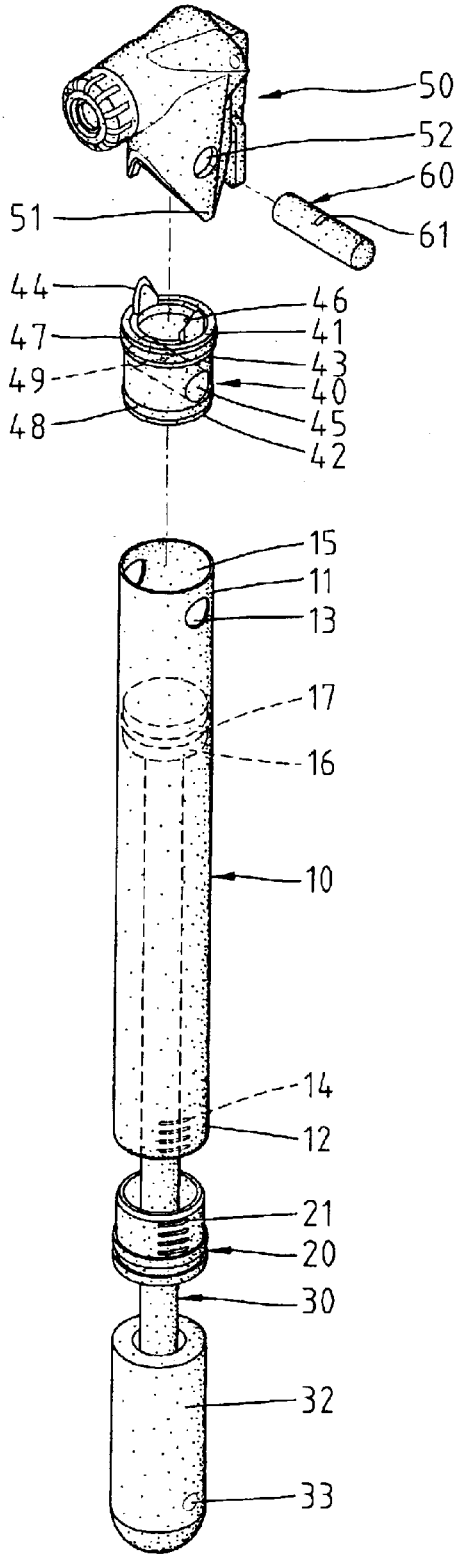
FIG. 2 is an exploded view of the pump shown in FIG. 1.
Figure 3:
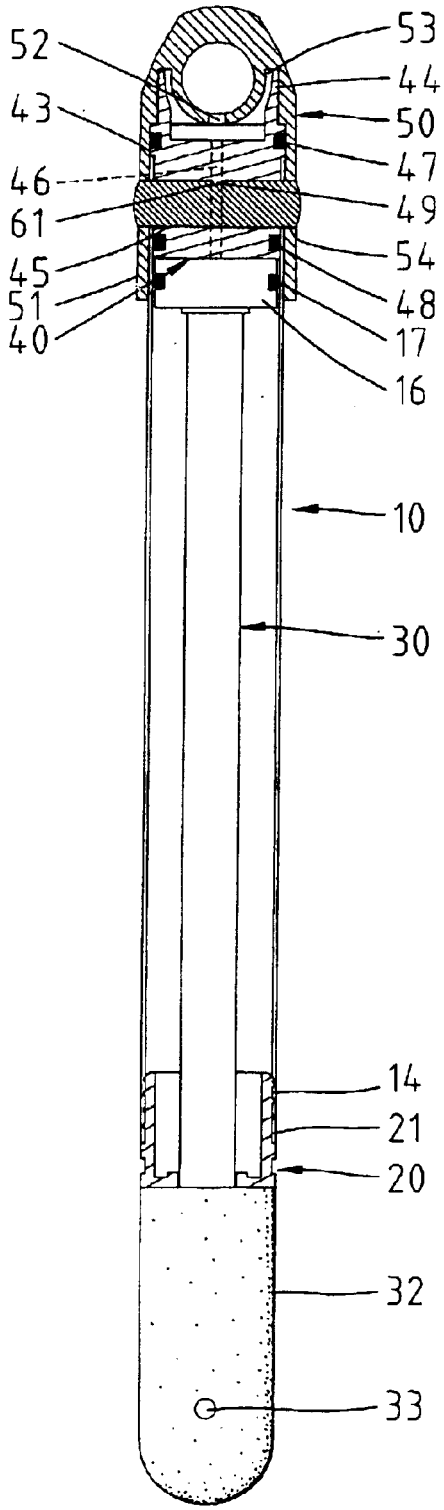
FIG. 3 is a cross-sectional view taken along a line 3—3 in FIG. 1.

Referring to FIGS. 1 and 2, according to a first embodiment of the present invention, a pump includes a cylinder 10, a piston 16, a connecting rod 30 and a nozzle 50.

The cylinder 10 includes a first open end 11 and a second open end 12. The cylinder 10 includes opposite holes 13 defined therein near the first open end 11, a plurality of ribs 14 formed on an internal side thereof near the second open end 12 and a channel 15 defined therein from the first open end 11 to the second open end 12.

The piston 16 is movable in the cylinder 10. A ring 17 is mounted on the piston 16.

The connecting rod 30 includes a first end to which the piston 16 is secured in the cylinder 10 and a second end to which a handle 32 is secured by a pin 33 outside the cylinder 10.

An annular plug 20 includes a plurality of grooves 21 defined in an external side thereof. The annular plug 20 is fit in the second open end 12 while the grooves 21 receive the ribs 14.

A plug 40 includes a first end 41 and a second end 42. The first end 41 of the plug 40 includes a diameter smaller than that of the second end 42 of the plug 40, thus forming an annular shoulder 43 between them. The plug 40 includes two tabs 44 extending from the first end 41 thereof, a transverse hole 45 extending through the second end 42 thereof and two longitudinal holes 46 extending through the entire length thereof. A ridge 49 is formed on the wall of the hole 45. On the plug 40, near the first end 41 thereof, is mounted a ring 47. On the plug 40, near the second end 42 thereof, is mounted a ring 48. The second end 42 of the plug 40 is fit in the first open end 11 of the cylinder 10. The hole 45 is aligned with the holes 13.

The nozzle 50 includes a neck 51, opposite holes 52 defined in the neck 51 and two recesses 53 defined in an internal side thereof. The neck 51 is mounted on the first end 41 of the plug 40 while the recesses 53 receive the tabs 44, thus preventing the nozzle 50 from pivoting on the plug 40. The neck 51 is mounted on the first open end 11 of the cylinder 10. The holes 52 are aligned with the holes 13 and 45.

A pin 60 defines a groove 61. The pin 60 is inserted in the holes the holes 52, 13 and 45 while the groove 61 receives the ridge 49, thus retaining the pin 60 in the holes 52, 13 and 45 and therefore the plug 40 on the cylinder 10.

Although not shown, according to a possible embodiment, the connecting rod 30 may be replaced with a connecting tube communicated with the nozzle 50. In operation, the cylinder 10 is reciprocated instead of the connecting tube. Accordingly, the plug 40 and the nozzle 50 are mounted on the connecting tube by the pin 60.

The present invention has been described through detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A pump including:

a cylinder including a first open end and a second open end;

a piston movable in the cylinder;

a connecting rod including a first end connected with the piston in the cylinder and a second end located outside the cylinder;

a plug fit in the first open end of the cylinder, the plug defining at least one longitudinal hole;

a nozzle mounted on the first open end of the cylinder; and a fastener extending from the nozzle into the cylinder and the plug and for fastening the nozzle and the plug to the cylinder.

2. The pump according to claim 1 wherein the plug includes a first end inserted in the nozzle and a second end inserted in the cylinder.

3. The pump according to claim 2 wherein the first end of the plug includes a diameter smaller than that of the second end of the plug, thus forming an annular shoulder between them for resting on the cylinder.

4. The pump according to claim 1 including an annular plug fit in the second open end of the cylinder.

5. The pump according to claim 4 wherein the cylinder includes at least one boss formed on an internal side thereof near the second open end, and the annular plug includes at least one recess defined in an external side thereof for receiving the at least one boss.

6. The pump according to claim 1 including a ring mounted on the piston.

7. The pump according to claim 1 including a handle secured to the connecting rod.

8. The pump according to claim 7 wherein the handle is secured to the connecting rod by means of a pin outside the cylinder.

9. A pump including:

a cylinder including a first open end and a second open end;

a piston movable in the cylinder;

a connecting rod including a first end connected with the piston in the cylinder and a second end located outside the cylinder;

a plug fit in the first open end of the cylinder, the plug defining at least one longitudinal hole;

a nozzle mounted on the first open end of the cylinder; and a fastener for fastening the nozzle and the plug to the cylinder, wherein the cylinder defines two holes near the first open end thereof, and the plug defines a transverse hole, and the nozzle defines two holes, and the fastener is a pin fit in the holes defined in the nozzle, the holes defined in the cylinder and the transverse hole defined in the plug.

10. The pump according to claim 9 wherein the plug includes a boss fanned on the wall of the transverse channel, and the pin defines a recess for receiving the boss of the plug.

11. A pump including:

a cylinder including a first open end and a second open end;

a piston movable in the cylinder;

a connecting rod including a first end connected with the piston in the cylinder and a second end located outside the cylinder;

a plug fit in the first open end of the cylinder, the plug defining at least one longitudinal hole;

a nozzle mounted on the first open end of the cylinder; and a fastener for fastening the nozzle and the plug to the cylinder, wherein the plug includes a first end inserted in the nozzle and a second end inserted in the cylinder, wherein the plug includes two tabs extending from the first end thereof, and the nozzle includes two recesses defined in an internal side thereof for receiving the tabs.

* * * * *